US008141489B2

(12) United States Patent
Belanger et al.

(10) Patent No.: US 8,141,489 B2
(45) Date of Patent: Mar. 27, 2012

(54) VARIABLE CUTOFF PRINTING UNIT AND METHOD OF PRINTING

(75) Inventors: James Richard Belanger, Hampton, NH (US); Matthew Thomas Sharkady, Victoria (AU)

(73) Assignee: Goss International Americas, Inc., Durham, NH (US)

( * ) Notice: Subject to any disclaimer, the term of this patent is extended or adjusted under 35 U.S.C. 154(b) by 888 days.

(21) Appl. No.: 12/214,876

(22) Filed: Jun. 23, 2008

(65) Prior Publication Data

US 2009/0064881 A1 Mar. 12, 2009

Related U.S. Application Data

(60) Provisional application No. 60/937,621, filed on Jun. 28, 2007.

(51) Int. Cl.

| | |
|---|---|
| ***B41F 1/34*** | (2006.01) |
| ***B41F 21/12*** | (2006.01) |
| ***B41F 21/14*** | (2006.01) |
| ***B41F 5/04*** | (2006.01) |
| ***B41F 13/02*** | (2006.01) |
| ***B41F 5/16*** | (2006.01) |
| ***B41F 5/18*** | (2006.01) |
| ***B41L 1/02*** | (2006.01) |

(52) U.S. Cl. ..... 101/485; 101/221; 101/180

(58) Field of Classification Search ..... 101/485, 101/483, 221, 220, 219, 180, 179, 178
See application file for complete search history.

(56) References Cited

U.S. PATENT DOCUMENTS

| | | | | |
|---|---|---|---|---|
| 640,447 | A * | 1/1900 | Corbin | 101/217 |
| 3,099,212 | A | 7/1963 | Sohn | |
| 3,691,948 | A | 9/1972 | Southam et al. | |
| 3,785,287 | A | 1/1974 | Dahlgren | |
| 5,209,159 | A | 5/1993 | Asanuma | |

(Continued)

FOREIGN PATENT DOCUMENTS

| | | |
|---|---|---|
| DE | 41 04 209 A1 | 8/1992 |

(Continued)

OTHER PUBLICATIONS

Web Offset, 2005, pp. 1 to 16, issue 56, Goss International Corporation, USA.

(Continued)

*Primary Examiner* — Judy Nguyen
*Assistant Examiner* — Leo T Hinze
(74) *Attorney, Agent, or Firm* — Davidson, Davidson & Kappel, LLC

(57) ABSTRACT

A variable cutoff printing unit is provided including a first upper plate cylinder carrying a first upper image, a first upper blanket cylinder including a first upper blanket print area for transferring the first upper image to a web and a first upper blanket non print area, a second upper plate cylinder carrying a second upper image, a second upper blanket cylinder including a second upper blanket print area for transferring the second upper image to the web and a second upper blanket non print area, a first lower plate cylinder carrying a first lower image, a first lower blanket cylinder including a first lower blanket print area for transferring the first lower image to the web and a first lower blanket non print area, a second lower plate cylinder carrying a second lower image and a second lower blanket cylinder including a second lower blanket print area for transferring the second lower image to the web and a second lower blanket non print area.

12 Claims, 4 Drawing Sheets

U.S. PATENT DOCUMENTS

| | | | | |
|---|---|---|---|---|
| 5,390,597 | A * | 2/1995 | Hashimoto et al. | 101/142 |
| 5,394,798 | A | 3/1995 | Simon et al. | |
| 5,711,225 | A * | 1/1998 | Rasmussen | 101/483 |
| 5,794,829 | A | 8/1998 | Perrault | |
| 5,813,336 | A | 9/1998 | Guaraldi et al. | |
| 5,816,151 | A | 10/1998 | Wang et al. | |
| 5,907,997 | A | 6/1999 | Jackson et al. | |
| 5,950,536 | A | 9/1999 | Erbstein | |
| 6,105,498 | A | 8/2000 | Vrotacoe et al. | |
| 6,205,920 | B1 | 3/2001 | Dzierzynski et al. | |
| 6,205,921 | B1 | 3/2001 | Dzierzynski et al. | |
| 6,327,975 | B1 | 12/2001 | Izawa | |
| 6,705,219 | B2 | 3/2004 | Douillard et al. | |
| 7,066,088 | B2 | 6/2006 | McLean et al. | |
| 2004/0020382 | A1 | 2/2004 | McLean et al. | |
| 2005/0061171 | A1 | 3/2005 | Angelo | |
| 2006/0191428 | A1 | 8/2006 | McLean et al. | |
| 2006/0196373 | A1 | 9/2006 | McLean et al. | |

FOREIGN PATENT DOCUMENTS

| | | | |
|---|---|---|---|
| DE | 44 42 983 | A1 | 12/1994 |
| EP | 0 547 753 | A1 | 6/1993 |
| EP | 1 084 832 | A1 | 3/2001 |
| FR | 980734 | | 5/1951 |
| JP | 7-266533 | | 10/1995 |
| WO | WO 95/20488 | | 8/1995 |
| WO | WO 2004/014654 | A1 | 2/2004 |

OTHER PUBLICATIONS

Web Offset, Spring 2007, pp. 1 to 20, issue 60, Goss International Corporation, USA.

* cited by examiner

VARIABLE CUTOFF PRINTING UNIT AND METHOD OF PRINTING

Priority is claimed to U.S. Provisional Application No. 60/937,621, filed Jun. 28, 2007, the entire disclosure of which is incorporated by reference herein.

BACKGROUND OF INVENTION

The present invention relates generally to a printing press and more specifically to a variable cutoff printing press and method.

U.S. Pat. No. 5,950,536 discloses a variable cutoff offset press unit. A fixed cutoff press is adapted to a variable cutoff press while maintaining the size of the blanket cylinders. A plate cylinder is mounted on a frame and includes a plate cylinder sleeve and a blanket cylinder is mounted on the frame, includes with a gapless blanket cylinder sleeve. The plate cylinder sleeve is variable, whereby a length of an image to be printed is varied proportionally to the variable outer diameter while maintaining the outer diameter of the gapless blanket cylinder sleeve constant. The size of a plate cylinder is changed by using a sleeve mounted over the plate cylinder or adding packing under a plate to increase the diameter of the plate cylinder.

U.S. Pat. No. 6,327,975 discloses a method and apparatus for printing elongate images on a web. A first printing unit prints a first image portion on the web at prescribed spacings, by moving the impression cylinder away from the blanket cylinder each time one first image portion is printed. A second printing unit prints a second image portion on the spacings left on the web by the first printing unit, also by moving the impression cylinder away from the blanket cylinder each time one second image portion is printed. A variable velocity motor rotates each blanket cylinder, while each time the associated impression cylinder is held away to create a space on the web for causing printing of the first or the second printing portion at required spacings.

U.S. Pat. No. 7,066,088 discloses a variable cut-off offset press system and method of operation which utilizes a continuous image transfer belt. The offset printing system comprises at least two plate cylinders adapted to have thereon respective printing sleeves. Each of the printing sleeves is adapted to receive colored ink from a respective ink source. The system further comprises at least an impression cylinder, wherein the image transfer belt is positioned to contact each of the printing sleeves at respective nips formed between respective ones of the plate cylinders and the at least one impression cylinder.

BRIEF SUMMARY OF THE INVENTION

A variable cutoff printing unit is provided including a first upper plate cylinder carrying a first upper image, a first upper blanket cylinder including a first upper blanket print area for transferring the first upper image to a web and a first upper blanket non print area, a second upper plate cylinder carrying a second upper image, a second upper blanket cylinder including a second upper blanket print area for transferring the second upper image to the web and a second upper blanket non print area, a first lower plate cylinder carrying a first lower image, a first lower blanket cylinder including a first lower blanket print area for transferring the first lower image to the web and a first lower blanket non print area, a second lower plate cylinder carrying a second lower image and a second lower blanket cylinder including a second lower blanket print area for transferring the second lower image to the web and a second lower blanket non print area. The first upper blanket non print area, the second upper blanket non print area, the first lower blanket non print area and the second lower blanket non print area move at a surface speed different that a speed of the web while passing the web during printing. The first upper image and the second upper image form one continuous upper image having an upper cutoff length.

A method of varying cutoff lengths of images printed on a web is also provided. The method includes transferring a first upper image from a first upper plate on a first upper plate cylinder to a first upper blanket cylinder and printing the first upper image on the web, and transferring a first lower image from a first lower plate on a first lower plate cylinder to a first lower blanket cylinder and printing the first lower image on the web. The first upper blanket cylinder and the first lower blanket cylinder contact via the web during printing. The method further includes transferring a second upper image from a second upper plate on a second upper plate cylinder to a second upper blanket cylinder and printing the second upper image on the web directly adjacent to the first upper image, and transferring a second lower image from a second lower plate on a second lower plate cylinder to a second lower blanket cylinder and printing the second lower image on the web directly adjacent to the first lower image. The second upper blanket cylinder and the second lower blanket cylinder contact via the web during printing. The first upper image and the second upper image form a continuous upper image having an upper cutoff length and the first lower image and the second lower image form a continuous lower image having a lower cutoff length. The method further includes removing the first upper plate from the first upper plate cylinder and replacing the first upper plate with first upper replacement plate having a first upper replacement image, removing the first lower plate from the first lower plate cylinder and replacing the first lower plate with a first lower replacement plate having a first lower replacement image, removing the second upper plate from the second upper plate cylinder and replacing the second upper plate with second upper replacement plate having a second upper replacement image, removing the second lower plate from the second lower plate cylinder and replacing the second lower plate with a second lower replacement plate having a second lower replacement image portion. The method further includes transferring the first upper replacement image from the first upper replacement plate on the first upper plate cylinder to the first upper blanket cylinder and printing the first upper replacement image on the web and transferring the first lower replacement image from a first lower replacement plate on the first lower plate cylinder to the first lower blanket cylinder and printing the first lower replacement image on the web. The method further includes transferring the second upper replacement image from the second upper replacement plate to the second upper blanket cylinder and printing the second upper replacement image on the web directly adjacent to the first upper replacement image. The method further includes transferring the second lower replacement image from the second lower replacement plate to the second lower blanket cylinder and printing the second lower replacement image on the web directly adjacent to the first lower replacement image. The first upper replacement image and the second upper replacement image form a continuous upper replacement image having an upper replacement cutoff length that varies from the upper cutoff length. The first lower replacement image and the second lower replacement image form a continuous lower replacement image having a lower replacement cutoff length that varies from the lower cutoff length. At least one of the first upper blanket cylinder and the second upper blanket cylinder is rotated at varying velocities during operation and has a surface speed different than a speed of the web as the velocity is varied. At least one of the first lower blanket cylinder and the second lower blanket cylinder is rotated at varying velocities during operation and has a surface speed different than a speed of the web as the velocity is varied.

BRIEF DESCRIPTION OF THE DRAWINGS

The present invention is described below by reference to the following drawings, in which.

DETAILED DESCRIPTION

Figure 1:
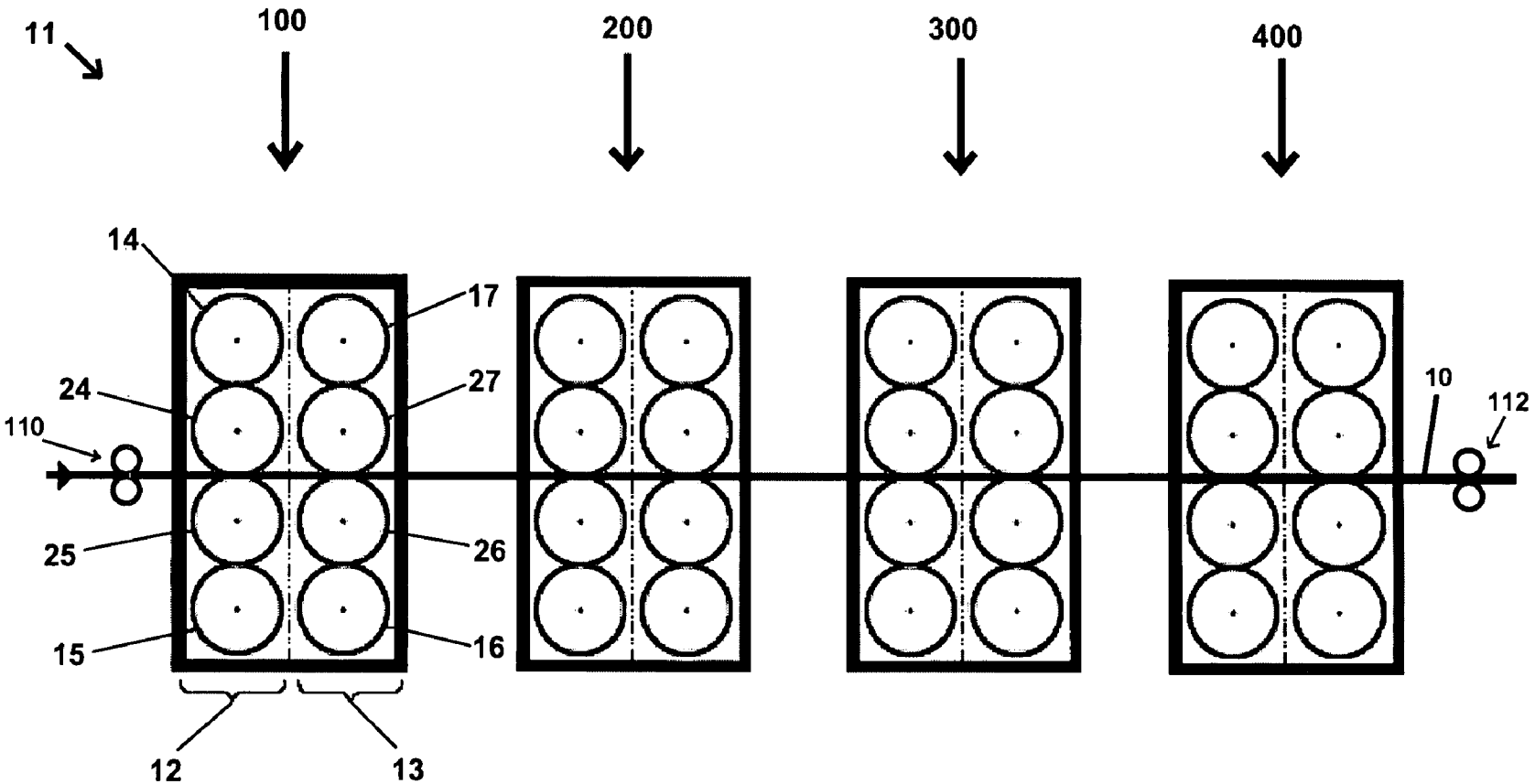
FIG. 1 shows a schematic side view of an embodiment of a printing press according to an embodiment of the present invention.

FIG. 1 shows a schematic side view of a variable cutoff printing press 11 according to an embodiment of the present invention. Printing press 11 includes variable cutoff print units 100, 200, 300, 400. Print unit 100 is separated into two independently driven print sections, first print section 12 and second print section 13, as shown in FIG. 1. Print unit 100 can print one color, for example cyan, and similarly constructed print units 200, 300, 400 can print other colors, for example magenta, yellow and black. Together, print units 100, 200, 300, 400 print four color images on web 10.

First print section 12 includes an upper blanket cylinder 24 contacting an upper plate cylinder 14 and a lower blanket cylinder 25 contacting a lower plate cylinder 15. Second print section 13 includes an upper blanket cylinder 27 contacting an upper plate cylinder 17 and a lower blanket cylinder 26 contacting a lower plate cylinder 16. A web 10 passes through nips formed between blanket cylinders 24, 25 and blanket cylinders 26, 27. Plate cylinders 14, 15, 16, 17 can have the same diameter and be driven at the same velocity during printing as blanket cylinders 24, 25, 26, 27, respectively.

Images are transferred from plate cylinders 14, 15, 16, 17 to blanket cylinders 24, 25, 26, 27, respectively. Blanket cylinders 24, 27 print images on a first side of web 10 and blanket cylinders 25, 26 print images on a second side of web 10. A nip roller pair 110 may be provided upstream of print unit 100 and a nip roller pair 112 may be provided downstream of print unit 400 to help ensure proper alignment and tension of web 10 during printing.

Printing sections 12, 13 alternate printing images on both sides of web 10, with each blanket cylinder 24, 25, 26, 27 printing every other image on a corresponding side of web 10. After each blanket cylinder 24, 25 prints an image on web 10, each blanket cylinder 24, 25, while still rotating, ceases to print so unprinted spaces are left on web 10, upon which blanket cylinders 26, 27 will print images. Blanket cylinders 26, 27 print images in unprinted spaces left by blanket cylinders 24, 25 and do not print images on web 10 as images printed on web 10 by cylinders 24, 25 pass between cylinders 26, 27.

Images printed by blanket cylinders 24, 25, 26, 27 have an image length that is less than a length of a circumference of blanket cylinders 24, 25, 26, 27, respectively. Thus, a portion of the circumference of each blanket cylinder 24, 25, 26, 27 does not receive images from respective plate cylinder 14, 15, 16, 17, and is a non print area. Accordingly, a portion of the circumference of each plate cylinder 14, 15, 16, 17 is a non print area and not transfer images to blanket cylinders 24, 25, 26, 27, respectively. In order to align images printed by print section 12 with images printed by print section 13, the circumferential phasing between print section 12 and print section 13 is a function of the spacing between print sections 12, 13.

If the circumference of each blanket cylinders 24, 25, 26, 27 is twice the cutoff (image length) of respective images printed by each blanket cylinder 24, 25, 26, 26, then an angular velocity of blanket cylinders 24, 25, 26, 27 remains constant. If the circumference of each blanket cylinder 24, 25, 26, 27 is not exactly twice the cutoff of respective images printed by each blanket cylinder 24, 25, 26, 27, then blanket cylinders 24, 25, 26, 27 must be individually accelerated and decelerated when blanket cylinders 24, 25, 26, 27 are not printing images on web 10. Acceleration and deceleration of blanket cylinders 24, 25, 26, 27 causes blanket cylinders 24, 25, 26, 27 to travel a surface speed that is different than a speed of web 10.

Figure 2:
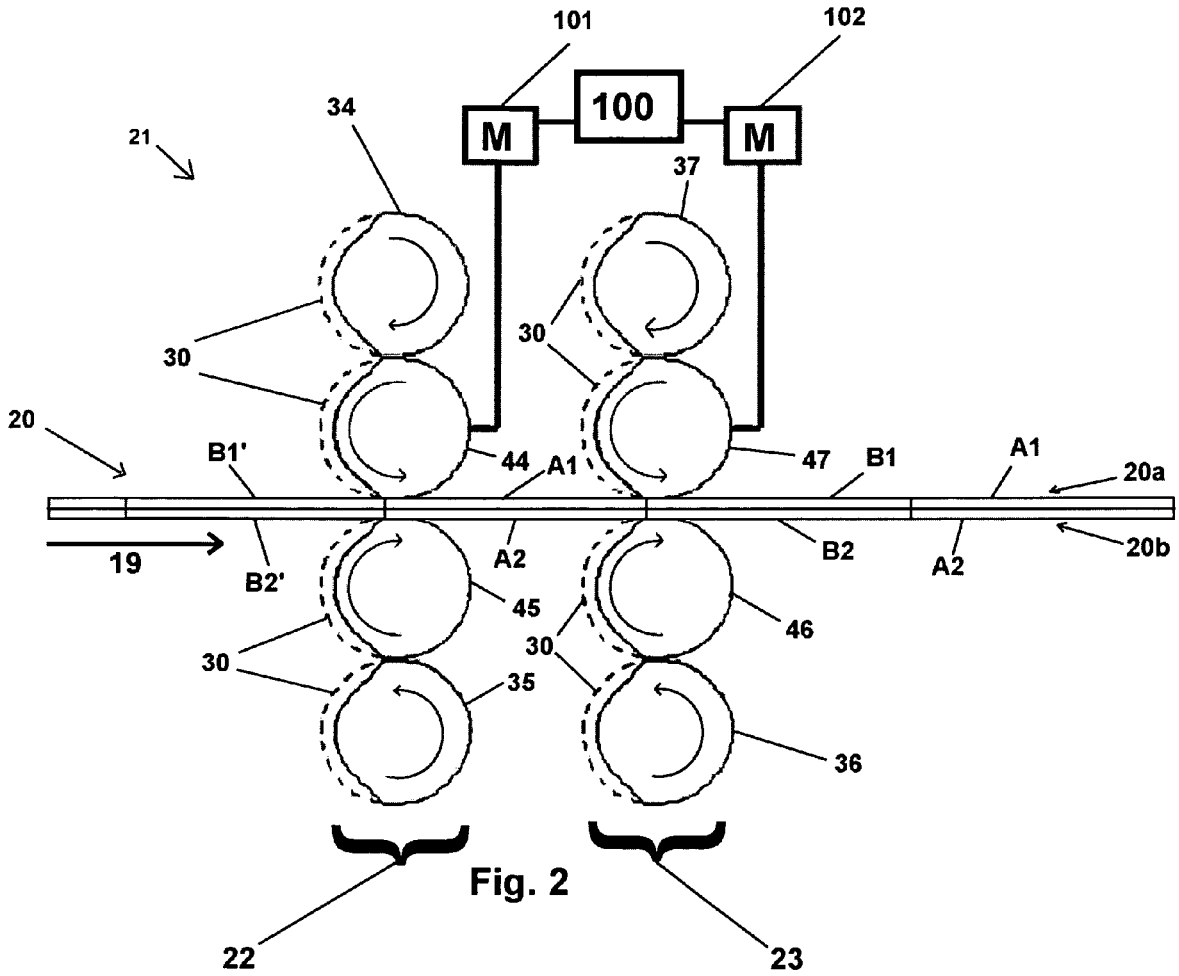
FIG. 2 shows schematic side view of a print unit according to an embodiment of the present invention.

FIG. 2 shows a schematic side view of a variable cutoff print unit 21 according to an embodiment of the present invention. Print unit 21 includes printing sections 22, 23. Each printing section 22, 23 includes an upper plate cylinder 34, 37, a lower plate cylinder 35, 36, an upper blanket cylinder 44, 47, and a lower blanket cylinder 45, 46, respectively. A web 20 travels in a direction 19 at a constant velocity and passes between a nip formed by blanket cylinders 44, 45 and a nip formed by blanket cylinders 46, 47. Cylinders 34, 35, 44, 45 are rotated by a motor 101 and cylinders 36, 37, 46, 47 are rotated by a motor 102. Controller 100 controls motors 101, 102.

Web 20 is schematically shown divided into an upper surface 20*a* and a lower surface 20*b*. Blanket cylinders 44, 47 print images A1, B1, respectively on upper surface 20*a* and blanket cylinders 45, 46 print images A2, B2 on lower surface 20*b*. Blanket cylinders 44, 47 are phased to print in a pattern with images A1, B1 directly following each other. Blanket cylinder 44 leaves spaces in between images A1, in which blanket cylinder 47 prints images B1. Blanket cylinders 45, 46 are phased to print in a pattern with images A1, B1 directly following each other. Blanket cylinder 45 leaves spaces in between images A2, in which blanket cylinder 46 prints images B2. As blanket cylinders 44, 45, 46, 47 print on web 20, blanket cylinders 44, 45, 46, 47 travel at a surface speed that is equal to a speed of web 20.

Each plate cylinder 34, 35, 36, 37 and each blanket cylinder 44, 45, 46, 47 includes a relieved portion 30. Relieved portions 30 allow blanket cylinders 44, 45, 46, 47 to travel at surface speeds different from the speed of web 20 when blanket cylinders 44, 45, 46, 47 are not printing on web 20. This allows motors 101, 102 to accelerate and decelerate blanket cylinders 44, 45, 46, 47 without blanket cylinders 44, 45, 46, 47 contacting web 20 and allows blanket cylinders 44, 45, 46, 47 to be in position to print images A1, A2, B2, B1, respectively, on web 20 in proper alignment. In an alternative embodiment blanket cylinders 44, 45, 46, 47 include relived or cut-out portions 30, but plate cylinders 34, 35, 36, 37 do not.

In FIG. 2, blanket cylinders 44, 45 have almost finished printing images A1, A2 on respective surfaces 20*a*, 20*b*. After images A1, A2 are completed, blanket cylinders 44, 45 continue to rotate and as relieved or cut-out portions 30 of blanket cylinders 44, 45 rotate past web 20, blanket cylinders 44, 45 do not contact web 20. Blanket cylinders 44, 45 are rotated by motor 101 at varying velocities as blanket cylinders 44, 45 are out of contact with web 20 so that blanket cylinders 44, 45 are in position to print images on web 20 after unprinted spaces B1', B2' of web 20 pass between blanket cylinders 44, 45. Blanket cylinders 46, 47 will print images in spaces B1', B2', respectively.

Blanket cylinders 46, 47 have almost finished printing images B1, B2 on respective surfaces 20*a*, 20*b*. Blanket cylinders 46, 47 began printing images B1, B2, respectively, on web 20 directly after images A1, A2, respectively. After images B1, B2 have been printed on web 20, blanket cylinders 46, 47 continue to rotate and as relieved portions of blanket cylinders 46, 47 rotate past web 20, blanket cylinders 46, 47 do not contact web 20. Blanket cylinders 46, 47 are rotated by motor 102 at varying velocities as blanket cylinders 46, 47 are out of contact with web 20 so that blanket cylinders 46, 47 are in position print to images on web 20 in spaces B1', B2', respectively, after images A1, A2 pass between blanket cylinders 46, 47.

Figure 3:
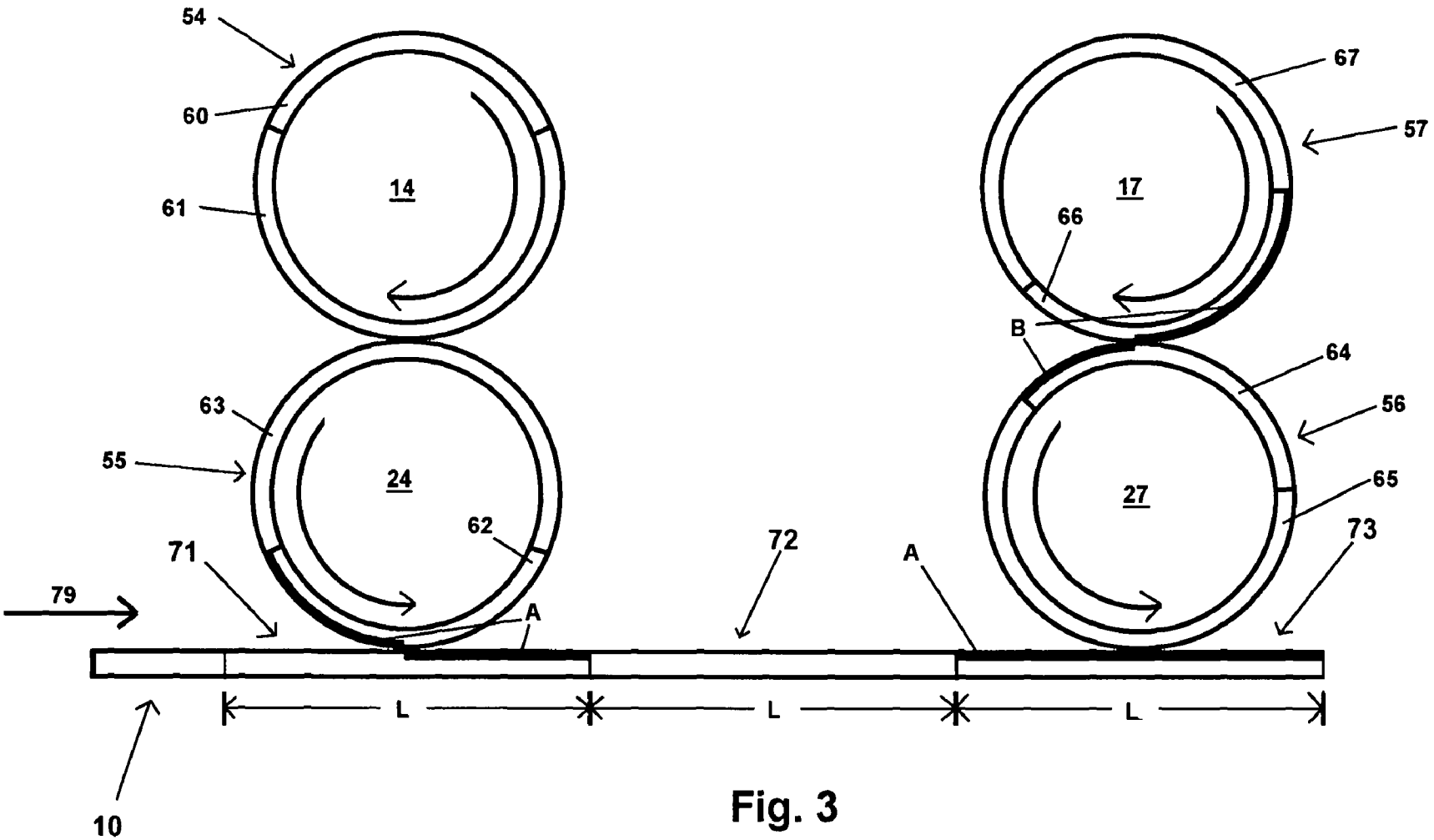
FIG. 3 shows an enlarged schematic side view of plate cylinders and blanket cylinders shown in FIG. 1, including plates and blankets.

FIG. 3 shows a enlarged schematic side view of plate cylinders 14, 17 and blanket cylinders 24, 27 and shown in FIG. 1, equipped with plates 54, 57 and blankets 55, 56, respectively, printing on web 10. Cylinders 15, 16, 25, 26 shown in FIG. 1 have been omitted for illustrative purposes only. Cylinders 15, 16, 25, 26 are configured similarly to cylinders 14, 17, 24, 27 and print on the opposite side of web 10 in a manner similar to cylinders 14, 17, 24, 27. Cylinders 14, 24 print images A and cylinders 15, 25 print images B. Plate cylinders 14, 17 rotate clockwise to transfer images A, B to blanket cylinders 24, 27, respectively. Blanket cylinders 24, 27 rotate counterclockwise to receive images A, B from plate cylinders 14, 17 and print images A, B, respectively, on web 10. Images A, B each are a length $L_I$ that is less than half of a length of a circumference of each cylinder 14, 17, 24, 27 (circumferences of cylinders 14, 17, 24, 27 include plates 54, 57 and blankets 55, 56 on outer surfaces of cylinders 14, 17, 24, 27, respectively). Thus, images A, B each have a cutoff of length $L_I$.

Outer circumferences of plates 54, 57 and blankets 55, 56, as wrapped around cylinders 14, 17, 24, 27 respectively, are the same length. For this to be possible, cylinders 14, 17 may vary in thickness from cylinders 24, 27 because plates 54, 57 may vary in thickness from blankets 55, 56. Plates 54, 57 are shown schematically divided into print areas 60, 66 and non print areas 61, 67, respectively. Print areas 60, 66 may be portions of plates 54, 57 that are prepared to receive ink in manner forming inked images A, B on plates 54, 57, respectively. Blankets 55, 56 are also shown schematically divided into print areas 62, 64 and non print areas 63, 65, respectively. Print areas 62, 64 may be portions of blankets 55, 56 that receive images A, B from print areas 60, 66, respectively, and print images A, B on web 10. Non prints areas 61, 63, 65, 67 are not involved in printing images A, B and do not carry ink. Print areas 60, 62, 64, 66 are each of a length $L_P$ (FIG. 4) that is equal to length $L_I$ of images A, B, while non print areas 61, 63, 65, 67 are of a length $L_{NP}$ (FIG. 4) that is greater than length $L_I$. However, in alternative embodiments, the print areas may be longer than the non print areas.

As non print area 63 is rotated past web 10, a velocity of blanket cylinder 24 may be varied so that blanket 55 travels at a surface velocity that varies from a velocity of web 10, which travels at a constant velocity. Because blanket 55 print images A on web 10 that are each separated by a distance of the length $L_I$ of image B, the entire non print area 61 passes by web 10 as web 10 travels a distance of length $L_I$. During each rotation, blanket cylinder 24 is accelerated after a first image A is printed and decelerated before a next image A is printed. This allows print area 64 to be in an appropriate position during each revolution, but allows blanket 55 to return to traveling at the same speed as web 10 when print area 64 contacts web 10. During each revolution, after blanket 55 prints one image A, print area 64 receives a next image A from plate 54. As print area 62 prints images A on web 10, blanket cylinder 24 is rotated so that the outer surface of blanket 55 is traveling at the same velocity as web 20. Thus, for each revolution of blanket cylinder 24, blanket cylinder 24 is accelerated and decelerated. In this embodiment, plate 54 and blanket 55 are traveling at the same surface velocity throughout each revolution, thus plate cylinder 14 is accelerated and decelerated along with blanket cylinder 24. Blanket cylinder 27 and plate cylinder 17 operate in a manner similar to blanket cylinder 24 and plate cylinder 14, respectively.

The rotation of blanket cylinders 24, 27 at surface velocities that vary from the velocity of web 10 may be achieved via relief as shown in FIG. 2. Also, for example, surfaces of blanket cylinders 24, 27 may possibly slip in relation to web 10 via a special non stick coating on the non print areas 63, 65 of blanket cylinders 24, 27 that does not affect the travel of web 10. In one embodiment, such a non stick coating may be used only on blanket cylinder 24 if the coating does not prevent smearing by blanket cylinder 27 of images A printed by blanket cylinder 24 on web 10. In another embodiment, to prevent smearing by blanket cylinder 27 of images printed by blanket cylinder 24, a heat setter may dry web 10 as web 10 passes between blanket cylinders 24, 27. During slipping, axes of cylinders 14, 17, 24, 27 remain stationary.

As shown in FIG. 3, blanket cylinder 24 is in the middle of printing an image A in space 71 on web 10, with a surface speed of blanket 55 equal to a speed of web 10. Image A being printed in space 71 is shown partially in space 71 and partially on print area 62. An image A was printed in a space 73 by blanket cylinder 24 during the previous revolution of blanket cylinder 24. In between spaces 71, 73 is a blank space 72, which is a length $L_I$, for blanket cylinder 27 to print image B. As blanket cylinder 24 prints image A in space 71 plate cylinder 14 receives ink from inkers to create another image A on plate cylinder 14.

Blanket cylinder 27 is receiving image B on print area 64 from print area 66 of plate cylinder 17. As image A in space 73 is passing by blanket cylinder 27, blanket cylinder 27 is not printing on web 10. Blanket cylinder 27 may be in the process of being accelerated, so that blanket 56 is in proper position to print image B in blank space 72 when blank space 72 passes by blanket cylinder 27. Cylinders 17, 27 are traveling at the same velocity, thus cylinder 17 may also be in the process of being accelerated.

Blanket cylinders 24, 27 can print images A, B, respectively, each having a cutoff length equal to or less than the length of print areas 63, 64. In order to vary the cutoff length of images printed by blankets 55, 56, print areas 60, 66 of plates 54, 57, respectively, may be varied. Cutoff length may be varied by replacing plates 54, 57 with plates including print areas of lengths that vary from lengths of print areas 60, 66, respectively. When print areas 60, 66 of plates are changed velocities which blanket cylinders 24, 27 are rotated must be adjusted so images A, B are printed on web 10 in proper alignment.

Images A, B may form one continuous image having a single cutoff length. Thus, the cutoff length of the continuous image formed by images A, B may be varied by varying the length of image A or image B separately, or by varying both images A, B.

Figure 4:
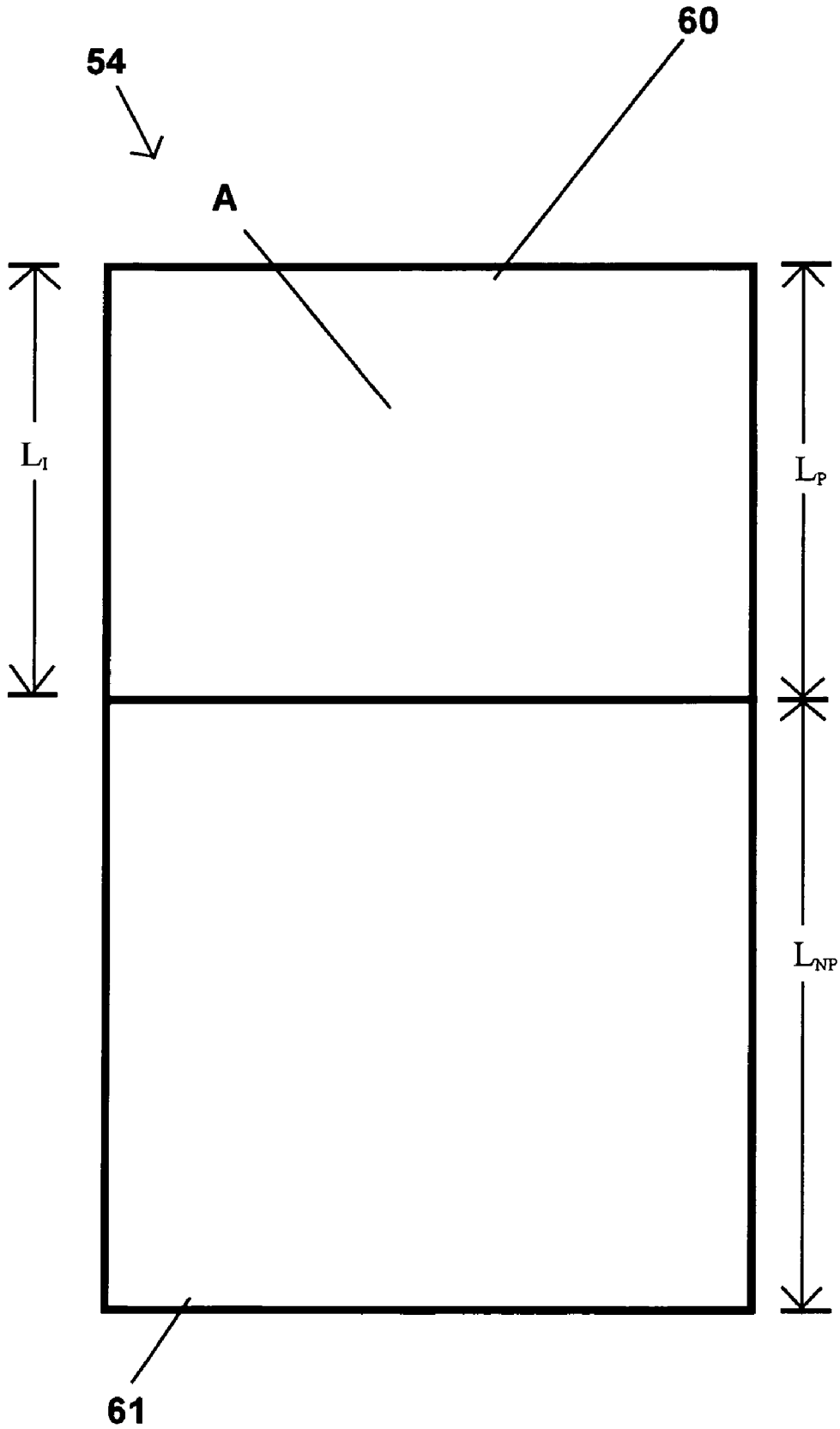
FIG. 4 shows a schematic top view of a plate show in FIG. 3 removed from a plate cylinder and laying flat.

FIG. 4 shows a schematic top view of plate 54 shown in FIG. 3 removed from plate cylinder 14 and laying flat. Plate 54 includes print area 60 and non print area 61. Plate 54 is carrying image A of length $L_I$ on print area 60. Print area 60 is a length $L_P$ that is equal to length $L_I$. Non print area 61 is of a length $L_{NP}$ that is greater than length $L_I$. Plate 57, shown in FIG. 3, may be similarly configured with print area 66 of length $L_P$ and non print area 67 of length $L_{NP}$, but carrying image B. Surfaces of blankets 55, 56, shown in FIG. 3, may also have print areas 62, 64, respectively, of length $L_P$ and non print areas 63, 65, respectively, of length $L_{NP}$.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A variable cutoff printing unit comprising:

a first upper plate cylinder carrying a first upper image;

a first upper blanket cylinder including a first upper blanket print area for transferring the first upper image to a web and a first upper blanket non print area;

a second upper plate cylinder carrying a second upper image; and a second upper blanket cylinder including a second upper blanket print area for transferring the second upper image to the web and a second upper blanket non print area;

a first lower plate cylinder carrying a first lower image;

a first lower blanket cylinder including a first lower blanket print area for transferring the first lower image to the web and a first lower blanket non print area;

a second lower plate cylinder carrying a second lower image;

a second lower blanket cylinder including a second lower blanket print area for transferring the second lower image to the web and a second lower blanket non print area;

at least one first motor driving the first upper blanket cylinder and the first lower blanket cylinder at varying velocities during each revolution; and at least one second motor driving the second upper blanket cylinder and the second lower blanket cylinder at varying velocities during each revolution;

wherein the first upper blanket non print area, the second upper blanket non print area, the first lower blanket non print area and the second lower blanket non print area move at a surface speed different than a speed of the web while passing the web during printing;

wherein the first upper image and the second upper image form one continuous upper image having an upper cutoff length;

wherein axes of the first upper plate cylinder, the first upper blanket cylinder, the first lower blanket cylinder, the first lower plate cylinder, the second upper plate cylinder, the second upper blanket cylinder, the second lower blanket cylinder and the second lower plate cylinder are stationary as the first upper blanket cylinder and the first lower blanket cylinder are driven at varying velocities during each revolution and as the second upper blanket cylinder and the second lower blanket cylinder are driven at varying velocities during each revolution.

2. The variable cutoff printing unit as recited in claim 1 wherein the first upper blanket non print area, the second upper blanket non print area, the first lower blanket non print area and the second lower blanket non print area are relieved portions allowing the first upper blanket non print area, the second upper blanket non print area, the first lower blanket non print area and the second lower blanket non print area to move at a surface speed different than a speed of the web while passing the web during printing.

3. The variable cutoff printing unit as recited in claim 1 wherein the first upper blanket non print area, the second upper blanket non print area, the first lower blanket non print area and the second lower blanket non print area include a non stick coating allowing the first upper blanket non print area, the second upper blanket non print area, the first lower blanket non print area and the second lower blanket non print area to move at a surface speed different than a speed of the web while passing the web during printing.

4. The variable cutoff printing unit as recited in claim 1 wherein the first upper plate cylinder includes a first upper plate prepared to carry the first upper image and the first upper plate may be replaced with a first upper replacement plate prepared to carry a first replacement upper image to vary the upper cutoff length.

5. The variable cutoff printing unit as recited in claim 1 wherein the at least one first motor drives the first upper plate cylinder and the first lower plate cylinder at varying velocities during printing.

6. The variable cutoff printing unit as recited in claim 1 wherein the at least one second motor drives the second upper plate cylinder and the second lower plate cylinder at varying velocities during printing.

7. The variable cutoff printing unit as recited in claim 1 wherein the first upper image and the second upper image are the same color.

8. A four color variable cutoff printing press comprising four printing units wherein each printing unit is the variable cutoff printing unit as recited in claim 1 and each printing unit prints in a separate color.

9. The four color variable cutoff printing press as recited in claim 8 wherein the printing press prints four color images.

10. A method of varying cutoff lengths of images printed on a web comprising:

transferring a first upper image from a first upper plate on a first upper plate cylinder to a first upper blanket cylinder and printing the first upper image on the web and transferring a first lower image from a first lower plate on a first lower plate cylinder to a first lower blanket cylinder and printing the first lower image on the web, the first upper blanket cylinder and the first lower blanket cylinder contacting via the web during printing;

transferring a second upper image from a second upper plate on a second upper plate cylinder to a second upper blanket cylinder and printing the second upper image on the web directly adjacent to the first upper image and transferring a second lower image from a second lower plate on a second lower plate cylinder to a second lower blanket cylinder and printing the second lower image on the web directly adjacent to the first lower image, the second upper blanket cylinder and the second lower blanket cylinder contacting via the web during printing, the first upper image and the second upper image forming a continuous upper image having an upper cutoff length and the first lower image and the second lower image forming a continuous lower image having a lower cutoff length;

removing the first upper plate from the first upper plate cylinder and replacing the first upper plate with first upper replacement plate having a first upper replacement image, removing the first lower plate from the first lower plate cylinder and replacing the first lower plate with a first lower replacement plate having a first lower replacement image portion, removing the second upper plate from the second upper plate cylinder and replacing the second upper plate with second upper replacement plate having a second upper replacement image, removing the second lower plate from the second lower plate cylinder and replacing the second lower plate with a second lower replacement plate having a second lower replacement image portion;

transferring the first upper replacement image from the first replacement upper plate on the first upper plate cylinder to the first upper blanket cylinder and printing the first upper replacement image on the web and transferring the first lower replacement image from a first lower replacement plate on the first lower plate cylinder to the first lower blanket cylinder and printing the first lower replacement image on the web;

transferring the second upper replacement image from the second upper replacement plate to the second upper blanket cylinder and printing the second upper replacement image on the web directly adjacent to the first upper replacement image and transferring the second lower replacement image from the second lower replacement plate to the second lower blanket cylinder and printing the second lower replacement image on the web directly adjacent to the first lower replacement image, the first upper replacement image and the second upper replacement image forming a continuous upper replacement image having an upper replacement cutoff length that varies from the upper cutoff length and the first lower replacement image and the second lower replacement image forming a continuous lower replacement image having a lower replacement cutoff length that varies from the lower cutoff length;

wherein at least one of the first upper blanket cylinder and the second upper blanket cylinder is rotated at varying velocities during operation and has a surface speed different than a speed of the web as the velocity is varied and at least one of the first lower blanket cylinder and the second lower blanket cylinder is rotated at varying velocities during operation and has a surface speed different than a speed of the web as the velocity is varied;

wherein axes of the first upper plate cylinder, the first upper blanket cylinder, the first lower blanket cylinder, the first lower plate cylinder, the second upper plate cylinder, the second upper blanket cylinder, the second lower blanket cylinder and the second lower plate cylinder remain stationary as the velocities of the at least one of the first upper blanket cylinder and the second upper blanket cylinder and the velocities of the at least one of the first lower blanket cylinder and the second lower blanket cylinder are varied.

11. The method of varying cutoff lengths of images printed on a web as recited in claim 10 wherein the at least one of the first upper blanket cylinder and the second upper blanket cylinder that is rotated at varying velocities during operation includes a relieved portion allowing the at least one of the first upper blanket cylinder and the second upper blanket cylinder to be rotated at varying velocities during operation and have a surface speed different than a speed of the web as the velocity is varied and the at least one of the first lower blanket cylinder and the second lower blanket cylinder that is rotated at varying velocities during operation includes a relieved portion allowing the at least one of the first lower blanket cylinder and the second lower blanket cylinder to be rotated at varying velocities during operation and have a surface speed different than a speed of the web as the velocity is varied.

12. The method of varying cutoff lengths of images printed on a web as recited in claim 10 wherein the at least one of the first upper blanket cylinder and the second upper blanket cylinder that is rotated at varying velocities during operation includes a non stick coating allowing the at least one of the first upper blanket cylinder and the second upper blanket cylinder to be rotated at varying velocities during operation and have a surface speed different than a speed of the web as the velocity is varied and the at least one of the first lower blanket cylinder and the second lower blanket cylinder that is rotated at varying velocities during operation includes a non stick coating allowing the at least one of the first lower blanket cylinder and the second lower blanket cylinder to be rotated at varying velocities during operation and have a surface speed different than a speed of the web as the velocity is varied.

* * * * *